United States Patent [19]

Minz

[11] Patent Number: 4,725,341

[45] Date of Patent: Feb. 16, 1988

[54] PROCESS FOR PERFORMING HCL-MEMBRANE ELECTROLYSIS

[75] Inventor: Franz-Rudolf Minz, Dormagen, Fed. Rep. of Germany

[73] Assignee: Bayer Aktiengesellschaft, Leverkusen, Fed. Rep. of Germany

[21] Appl. No.: 2,843

[22] Filed: Jan. 13, 1987

[30] Foreign Application Priority Data

Jan. 30, 1986 [DE] Fed. Rep. of Germany ..... 3602683

[51] Int. Cl.[4] ..... G25B 1/00

[52] U.S. Cl. ..... 204/128; 204/129

[58] Field of Search ..... 204/128, 129

[56] References Cited

U.S. PATENT DOCUMENTS 4,210,501 7/1980 Dempsey et al. ..... 204/129

4,279,712 7/1981 Satoh et al. ..... 204/129

*Primary Examiner*—John F. Niebling

*Assistant Examiner*—Kathryn Rubino

*Attorney, Agent, or Firm*—Sprung Horn Kramer & Woods

[57] ABSTRACT

A process for conducting HCl membrane electrolysis to produce $H_2$ and $Cl_2$ from an electrolyte cell comprising a cathode compartment and an anode compartment separated by a membrane comprising feeding a first stream of hydrochloric acid into an inlet of the cathode compartment, withdrawing a second stream of hydrochloric acid from an outlet of the cathode compartment withdrawing a third stream of hydrochloric acid from an outlet of the anode compartment, feeding a fourth stream of hydrochloric aicd into an inlet of the anode compartment, and feeding at least a portion of the second stream into the inlet of the anode compartment.

13 Claims, 2 Drawing Figures

PROCESS FOR PERFORMING HCL-MEMBRANE ELECTROLYSIS

BACKGROUND OF THE INVENTION

1. Field of the Invention

The present invention concerns an improved process for performing HC1-membrane electrolysis.

2. Background Information

According to the state of the art HCl is electrolysed by feeding an aqueous solution of hydrochloric acid into a plurality of individual cells each of which is separated by a diaphragm into two compartments. 30–45 of the individual units are put together to a stack, which is called electrolyser. Each cell of said electrolyser is connected to the catholyte and to the anolyte circulation system in a way, that the anolyte acid flows through all anode compartments in parallel and the catholyte acid flows through all cathode compartments in parallel. 30% hydrochloric acid is fed into both circuits in order to strengthen the weak acid to 20–26% (Winnacker Küchler: Chemische Technologie, volume 2, 4th edition, 1982, pages 443 ff).

A disadvantage of the diaphragm process is the fact, the anolyte and catholyte mix each other through the diaphragm, which cannot be controlled from outside, because the diaphragm is permeable to the electrolyte. In consequence the chlorine which has been dissolved in the anolyte acid is partly stripped off after it has penetrated onto the catholyte side, and thus leads to contamination of the hydrogen. Another part is reduced cathodically and thus leads to a reduction in the product/energy yield. A partial mixing of the gases, chlorine and hydrogen, which have been produced in the electrolysis process, can also occur through the diaphragm.

These disadvantages can be obviated by the use of an ion exchange membrane instead of the diaphragm. Thus, it has been suggested, in DE-A 2 844 499, that an ion exchange membrane, which has been coated with electrocatalysts on both sides be used, and that the current be supplied or withdrawn by feeder and collector electrodes. This process, which is described as the "solid polymer electrolyte" (SPE) system, has the advantage that only one electrolyte circuit is required, since the protons which are discharged on the cathode side migrate from the anode side through the membrane; thus, theoretically, no depletion with respect to ions takes place in the catholyte. However, in practice, hydration water goes over to the cathode side, and this must be removed.

One disadvantage of this process is, however, the fact that the current transfer from the feeder/collector electrodes onto the "working electrodes" is inside the electrolyte and thus defined current transfers can be adjusted only with difficulty and cannot be controlled from outside.

Another disadvantage in DE-A 2 844 499 is that the metal meshes which are proposed as feeder/collector electrodes are stable in industrial application only for a very short time on the anode side and only under cathodic protection on the cathode side. Corresponding mashes made of graphite which would be corrosion resistent are very expensive and are not very mechanically stable, because of the size of industrial electrolysors.

Reduced oxides from the group of nobel metals are used as electrocatalysts and are mixed with graphite to a greater or lesser extent. These systems are, however, far less stable than graphite under operating conditions. If, however, graphite has to be used for the feeder/collector electrodes simply for reasons of durability and also for the electrocatalytic layers on the membranes, the solid graphite electrodes of the original kind present no longer any significant disadvantages. Moreover, the problems which constantly occur in the adhesion of the electrocatalyst to the membrane are avoided.

If, however, the electrodes become separated from the membrane, a conductive electrolyte is also required on the cathode side. The maximum conductivity of aqueous hydrochloric acid is, as is well-known, at a level of concentration of between 17 and 22% by weight HCl. Since the concentration of HCl solution in the cathode region decreases as a result of the transfer of hydration water through the membrane the HCl solution must be replaced.

SUMMARY OF THE INVENTION

It is the aim of the present invention to provide a process for HCl electrolysis which would not present the disadvantages of the processes described above. This process would combine the advantage of the SPE-cell with only one electrolyte circuit with the advantage of an electrolysis cell with a final electrode/membrane gap.

This aim is achieved in a simple manner by a process for HCl membrane electrolysis in which at least a proportion of the electrolyte leaving the cathode compartment is directly supplied to the input of the anode chamber.

The concentrated hydrochloric acid which is to be electrolyzed is first fed into the catholyte chamber of a cell, which is divided by a cation exchange membrane into a cathode compartment and an anode compartment. The acid overflow, which has been diluted by the hydration water of the protons being transported from the anode compartment to the cathode compartment, is then introduced into the anolyte compartment of the cell. After depletion by the electrolysis, the weakened acid is discharged from the anolyte compartment and can be resaturated with gaseous HCl after the remaining chlorine has been stripped off. In the process according to the invention the hydration water which penetrates the membrane from the anode side is feedback by a short external feedback; the volume flow of weak acid which must be concentrated by HCl absorption is reduced by that proportion.

DETAILED DESCRIPTION OF THE INVENTION

A particular advantage of the present invention is afforded by the fact that the process according to the invention can be carried out in such a way that a proportion of the electrolyte which leaves the electrolyte compartments is feedback into the same electrolyte compartment in each case.

Figure 1:
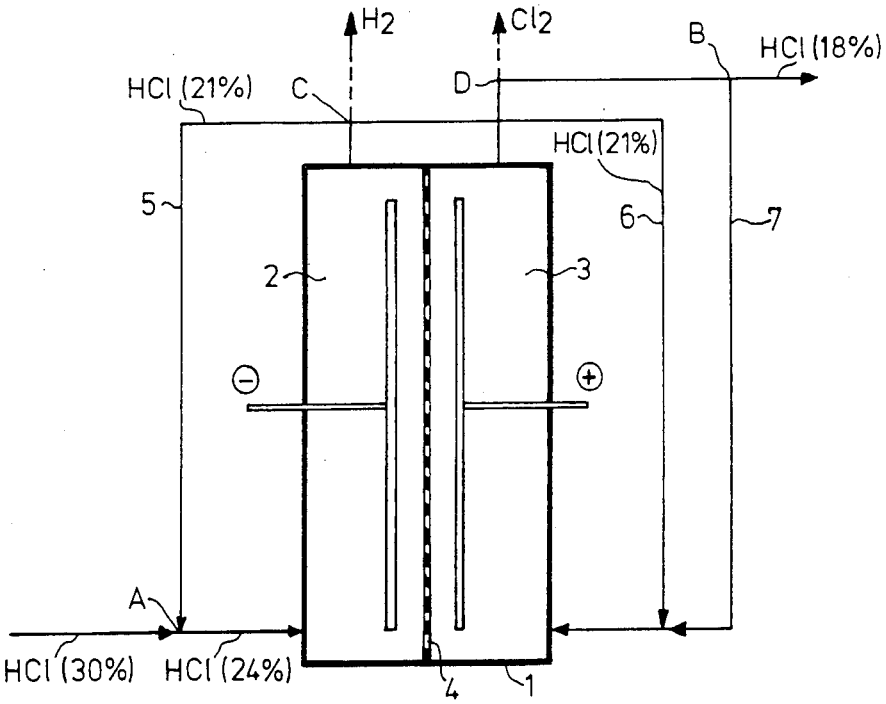
FIG. 1 is a schematic drawing showing a process according to the present invention.

FIG. 1 serves to clarify the process according to the invention. The quantity of concentrated hydrochloric acid which is fed at A (FIG. 1) is regulated in such a way that a corresponding quantity of depleted HC1 is drawn off at outlet B. In a case in which the concentration is 30% at A, and 18% at B, an average concentration of approximately 24% appears in the catholyte chamber at a specific load of 3 $KA/m^2$.

Figure 2:
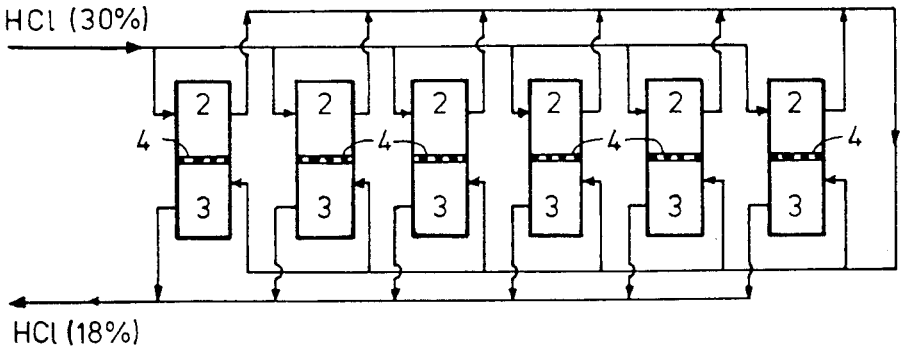
FIG. 2 is a circuit diagram showing a plurality of cells.

FIG. 2 shows one possible flow sheet according to the invention for a plurality of individual cells, for example, in an electrolysor which is composed of 30–45 individual elements.

In what follows the present invention is elucidated by an example without creating any restriction of the invention.

EXAMPLE

In FIG. 1, a cell 1 according to the invention is shown. An ion exchange membrane 4 (Nafion NX 430, from Du Pont of Wilmington, Del.) divides the cell into a cathode compartment 2 and an anode compartment 3. At point A, 0.2 l/h 30% hydrochloric acid is fed into the catholyte circuit 5 of the cell, and the mixture enters into the cell at the bottom. An appropriate quantity of 21% HCl flows over onto the anolyte side through pipe 6 and is fed into the anolyte circuit 7. The depleted acid finally leaves the cell at about 18% concentration. At point B, the corresponding quantity of HCl is taken out of the anolyte circuit with the result that its volume remains constant. With a specific load of 30 $A/dm^2$ and an electrolyte temperature of approximately 80° C., depending on the electrode gap, a cell voltage of between 1.9 and 2.1 volts is achieved. The products of the electrolysis chlorine and hydrogen, leave the cell together with the electrolyte; by means of the gas lift effect a greater quantity of electrolyte leaves the cell than the quantity of fresh acid which must be fed to keep the concentration in the above mentioned range. This excess quantity is immediately feedback to the cell inlet through the appropriate circuit pipes 5 and 7. The separation of the products, chlorine and hydrogen, from the appropriate electrolytes occurs in what are termed "gas separators" points C and D.

It will be appreciated that the instant specification and claims are set forth by way of illustration and not limitation, and that various modifications and changes may be made without departing from the spirit and scope of the present invention.

What is claimed is:

1. A process for electrolysis of HCl to produce $H_2$ and $Cl_2$ in an electrolytic cell comprising a cathode compartment and an anode compartment separated by an ionexchange membrane, comprising feeding a first stream of hydrochloric acid into an inlet of the cathode compartment, withdrawing a second stream of hydrochloric acid from an outlet of the cathode compartment, withdrawing a third stream of hydrochloric acid from an outlet of the anode compartment, feeding a fourth stream of hydrochloric acid into an inlet of the anode compartment, and feeding at least a portion of the second stream into the inlet of the anode compartment.

2. A process according to claim 1, which further comprises feeding a portion of the second stream into the inlet of the cathode compartment.

3. A process according to claim 1, which further comprises feeding a portion of the third stream into the inlet of the anode compartment.

4. A process according to claim 1, wherein the HCl concentration of the portion of the second stream is 21%.

5. A process according to claim 2, wherein the HCl concentration of the portion of the second steam is 21%

6. A process according to claim 3, wherein the HCl concentration of the portion of the third stream is 21%.

7. A process according to claim 1, wherein the HCl concentration of the first stream is 24%.

8. A process according to claim 1, wherein a catholyte circuit connects the first stream and the second stream.

9. A process according to claim 8, wherein the HCl concentration of the catholyte circuit is 21%.

10. A process according to claim 1, wherein an anolyte circuit connects the third stream and the fourth stream.

11. A process according to claim 10, wherein the HCl concentration of the anolyte circuit is 21%.

12. A process according to claim 8, wherein a 30% HCl-containing stream enters the catholyte circuit.

13. A process according to claim 10, wherein a 18% HCl-containing stream exits the anolyte circuit.

* * * * *